US009330618B2

(12) United States Patent
Yun et al.

(10) Patent No.: US 9,330,618 B2
(45) Date of Patent: May 3, 2016

(54) DRIVING CIRCUIT FOR DISPLAY DEVICE AND METHOD OF DRIVING THE SAME

(71) Applicant: LG Display Co., Ltd., Seoul (KR)

(72) Inventors: Sai-Chang Yun, Daegu (KR); You-Sung Nam, Gwangmyeong-si (KR); Si-Hyun Kim, Paju-si (KR); Nak-Yoon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 245 days.

(21) Appl. No.: 14/053,454

(22) Filed: Oct. 14, 2013

(65) Prior Publication Data

US 2014/0306872 A1 Oct. 16, 2014

(30) Foreign Application Priority Data

Apr. 12, 2013 (KR) ..... 10-2013-0040428
Aug. 30, 2013 (KR) ..... 10-2013-0104409

(51) Int. Cl.
*G09G 3/36* (2006.01)

(52) U.S. Cl.
CPC ..... *G09G 3/3618* (2013.01); *G09G 3/3614* (2013.01); *G09G 3/3688* (2013.01); *G09G 2310/0297* (2013.01); *G09G 2330/021* (2013.01); *G09G 2340/0435* (2013.01)

(58) Field of Classification Search
CPC .. G09G 3/3648; G09G 3/3688; G09G 3/3611
USPC ..... 345/87–100, 211–213
See application file for complete search history.

(56) References Cited

U.S. PATENT DOCUMENTS 5,691,745 A * 11/1997 Mital ..... G09G 5/399 345/536
5,764,082 A * 6/1998 Taylor ..... H03K 19/01855 326/81
6,373,459 B1 4/2002 Jeong
6,392,948 B1 * 5/2002 Lee ..... G11C 11/406 365/201
2007/0001978 A1 1/2007 Cho
2008/0143695 A1 6/2008 Juenemann et al.
2009/0322660 A1 * 12/2009 Chung ..... G09G 3/3648 345/87
2011/0012887 A1 * 1/2011 Lee ..... G09G 3/3648 345/212

FOREIGN PATENT DOCUMENTS

| | | |
|---|---|---|
| CN | 1801266 | 7/2006 |
| CN | 1892782 | 1/2007 |
| CN | 102122497 | 7/2011 |
| CN | 102498509 | 6/2012 |
| JP | 2007-334224 | 12/2007 |

OTHER PUBLICATIONS

Office Action for Chinese Patent Application No. 201310479152.X, Dec. 17, 2015, 16 pages.

* cited by examiner

*Primary Examiner* — Kimnhung Nguyen
(74) *Attorney, Agent, or Firm* — Fenwick & West LLP

(57) ABSTRACT

A driving circuit for a display device, for reducing power consumption of a data driver, and a method of driving the driving circuit are disclosed. The driving circuit includes a data driver for maintaining buffers of the data driver in an on state every preset specific frame period and maintaining the buffers in an off state every remaining period except for specific frame periods in a refresh mode for processing image data of one image for the specific frame periods only.

20 Claims, 12 Drawing Sheets

FIG. 12

| DVISION | LiTEST = Low | LiTEST = High | POWER | FULL-VDD STRUCTURE (Normal type) | | | | HVDD Case. 1 | | | |
|---|---|---|---|---|---|---|---|---|---|---|---|
| | | | | White | Black | H_1by1 | V-Sub-lines | White | Black | H_1by1 | V-Sub-lines |
| POWER CONSUMPTION (1026ch) [mW] | 60 frame | 0 frame | VCC | 9.90 | 8.82 | 17.10 | 11.34 | 9.90 | 8.82 | 17.10 | 11.34 |
| | | | SIDD | 65.60 | 72.27 | 72.32 | 70.79 | 49.13 | 54.12 | 54.03 | 54.25 |
| | | | DIDD | 0.00 | 0.00 | 124.08 | 0.00 | 0.01 | 0.01 | 60.68 | 0.00 |
| | | | HVDD | 0.00 | 0.00 | 0.00 | 0.00 | 3.11 | 0.05 | 0.43 | 2.01 |
| | | | Total | 75.50 | 81.09 | 89.42 | 82.13 | 62.14 | 62.99 | 71.56 | 67.60 |
| POWER CONSUMPTION (1026ch) [mW] | 1 frame | 59 frame | VCC | 0.17 | 0.15 | 0.29 | 0.19 | 0.17 | 0.15 | 0.29 | 0.19 |
| | | | SIDD | 1.09 | 1.20 | 1.21 | 1.18 | 0.82 | 0.90 | 0.90 | 0.90 |
| | | | DIDD | 0.00 | 0.00 | 2.07 | 0.00 | 0.00 | 0.00 | 1.01 | 0.00 |
| | | | HVDD | 0.00 | 0.00 | 0.00 | 0.00 | 0.05 | 0.00 | 0.01 | 0.03 |
| | | | Total | 1.26 | 1.35 | 1.50 | 1.37 | 1.04 | 1.05 | 1.20 | 1.12 |
| POWER CONSUMPTION (1026ch) [mW] | 5 frame | 55 frame | VCC | 0.83 | 0.74 | 1.43 | 0.95 | 0.83 | 0.74 | 1.43 | 0.95 |
| | | | SIDD | 5.47 | 6.02 | 6.03 | 5.90 | 4.09 | 4.51 | 4.50 | 4.52 |
| | | | DIDD | 0.00 | 0.00 | 10.34 | 0.00 | 0.00 | 0.00 | 5.06 | 0.00 |
| | | | HVDD | 0.00 | 0.00 | 0.00 | 0.00 | 0.26 | 0.00 | 0.04 | 0.17 |
| | | | Total | 6.30 | 6.76 | 7.46 | 6.85 | 5.18 | 5.25 | 5.97 | 5.64 |
| POWER CONSUMPTION (1026ch) [mW] | 10 frame | 50 frame | VCC | 1.65 | 1.47 | 2.85 | 1.89 | 1.65 | 1.47 | 2.85 | 1.89 |
| | | | SIDD | 10.93 | 12.04 | 12.05 | 11.80 | 8.19 | 9.02 | 9.00 | 9.04 |
| | | | DIDD | 0.00 | 0.00 | 20.68 | 0.00 | 0.00 | 0.00 | 10.11 | 0.00 |
| | | | HVDD | 0.00 | 0.00 | 0.00 | 0.00 | 0.52 | 0.01 | 0.07 | 0.33 |
| | | | Total | 12.58 | 13.51 | 14.90 | 13.69 | 10.36 | 10.50 | 11.92 | 11.26 |

DRIVING CIRCUIT FOR DISPLAY DEVICE AND METHOD OF DRIVING THE SAME

CROSS-REFERENCE TO RELATED APPLICATIONS

This application claims the benefit of Korean Patent Application No. 10-2013-0040428 filed on Apr. 12, 2013 and Korean Patent Application No. 10-2013-0104409 filed on Aug. 30, 2013, which are hereby incorporated by reference as if fully set forth herein.

BACKGROUND OF THE INVENTION

1. Field of the Invention

The present invention relates to a driving circuit for a display device, and more particularly, to a driving circuit for a display device, for reducing power consumption of a data driver and a method of driving the driving circuit.

2. Discussion of the Related Art

A typical liquid crystal display (LCD) device adjusts the light transmittance of liquid crystals using an electric field, thereby displaying an image. To this end, an LCD device includes a liquid crystal panel in which pixel regions are arranged in a matrix form and a driving circuit for driving the liquid crystal panel.

The driving circuit includes a timing controller, a gate driver, a data driver, and so on. In this regard, buffers in the data driver are continuously driven to be on regardless of image characteristics, and thus, problems arise in that power consumed by the data driver is significantly high.

SUMMARY OF THE INVENTION

Accordingly, the present invention is directed to a driving circuit for a display device and a method of driving the same that substantially obviates one or more problems due to limitations and disadvantages of the related art. The driving circuit and the method may significantly reduce power consumption by turning off buffers installed in a data driver for remaining frame periods except for specific frame periods in which image data is processed in a low speed refresh mode in which a still image is process.

An object of the present invention is to provide a driving circuit for a display device, including a data driver for maintaining buffers of the data driver in an on state every preset specific frame period and maintaining the buffers in an off state every remaining period except for specific frame periods in a refresh mode for processing image data of one image for the specific frame periods only.

The buffers may include a plurality of positive buffers for receiving a high voltage and a low voltage to output a positive data voltage, and a plurality of negative buffers for receiving the high voltage and the low voltage to output a negative data voltage, and the buffers may further include a plurality of first buffer control switches connected between each of the plurality of positive buffers and a high voltage transmission line for transmitting the high voltage, a plurality of second buffer control switches connected between each of the plurality of positive buffers and a low voltage transmission line for transmitting the low voltage, a plurality of third buffer control switches connected between each of the plurality of negative buffers and a high voltage transmission line for transmitting the high voltage, and a plurality of fourth buffer control switches connected between each of the plurality of negative buffers and a low voltage transmission line for transmitting the low voltage.

The data driver may turn on the first through fourth buffer control switches every specific frame period to hold the positive and negative buffers in an on state and turn off the first through fourth buffer control switches every remaining frame period except for the specific frame periods to hold the positive and negative buffers in an off state.

The driving circuit may further include a timing controller for generating a low refresh rate signal having a low state every the specific frame period and having a high state every the remaining frame period, and providing the low refresh rate signal to the first through fourth buffer control switches.

The driving circuit may further include a timing controller for generating a low refresh rate signal having a low state every specific frame period and having a high state every remaining frame period, and a switch controller for controlling operations of the first through fourth buffer control switches according to the low refresh rate signal from the timing controller.

The switch controller may turn on the first through fourth buffer control switches when the low refresh rate signal is in a low state, and the switch controller may turn off the first through fourth buffer control switches when the low refresh rate signal is in a high state.

The driving circuit may further include a level shifter for shifting a level of the low refresh rate signal from the timing controller and providing the low refresh rate signal to the switch controller.

Time corresponding to one specific frame period may be 16.6 ms or 8.3 ms.

Remaining frame periods between two specific adjacent frame periods may be set such that time corresponding to the remaining frame periods between the two specific adjacent frame periods is greater than time corresponding to one specific frame period of the two specific adjacent frame periods.

Remaining frame periods between two specific adjacent frame periods may be set such that time corresponding to a remaining frame period is the same as time corresponding to one specific frame period of the two specific adjacent frame periods.

Another object of the present invention is to provide a method of driving a driving circuit for a display device, the method including maintaining buffers of a data driver in an on state every preset specific frame period and maintaining the buffers in an off state every remaining period except for specific frame periods in a refresh mode for processing image data of one image for the specific frame periods only.

The buffers may include a plurality of positive buffers for receiving a high voltage and a low voltage to output a positive data voltage, and a plurality of negative buffers for receiving the high voltage and the low voltage to output a negative data voltage, and the maintaining may include holding the positive and negative buffers in an on state by turning on a plurality of first buffer control switches connected between each of the plurality of positive buffers and a high voltage transmission line for transmitting the high voltage, a plurality of second buffer control switches connected between each of the plurality of positive buffers and a low voltage transmission line for transmitting the low voltage, a plurality of third buffer control switches connected between each of the plurality of negative buffers and a high voltage transmission line for transmitting the high voltage, and a plurality of fourth buffer control switches connected between each of the plurality of negative buffers and a low voltage transmission line for transmitting the low voltage, and holding the positive and negative buffers in an off state by turning off the first through fourth buffer control switches.

The method may further include generating a low refresh rate signal having a low state every specific frame period and having a high state every remaining frame period, and providing the low refresh rate signal to the first through fourth buffer control switches.

The method may further include generating a low refresh rate signal having a low state every specific frame period and having a high state every remaining frame period, and controlling operations of the first through fourth buffer control switches according to the low refresh rate signal.

The controlling of the operations of the first through fourth buffer control switches may include turning on the first through fourth buffer control switches when the low refresh rate signal is in a low state, and turning off the first through fourth buffer control switches when the low refresh rate signal is in a high state.

The method may further include shifting a level of the generated low refresh rate signal.

The buffers may be maintained in an on state in a normal refresh mode for processing image data of one frame every frame period.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 12 is a view for explanation of an effect of a driving circuit for a display device according to an embodiment of the present invention.

DETAILED DESCRIPTION OF THE INVENTION

Figure 1:
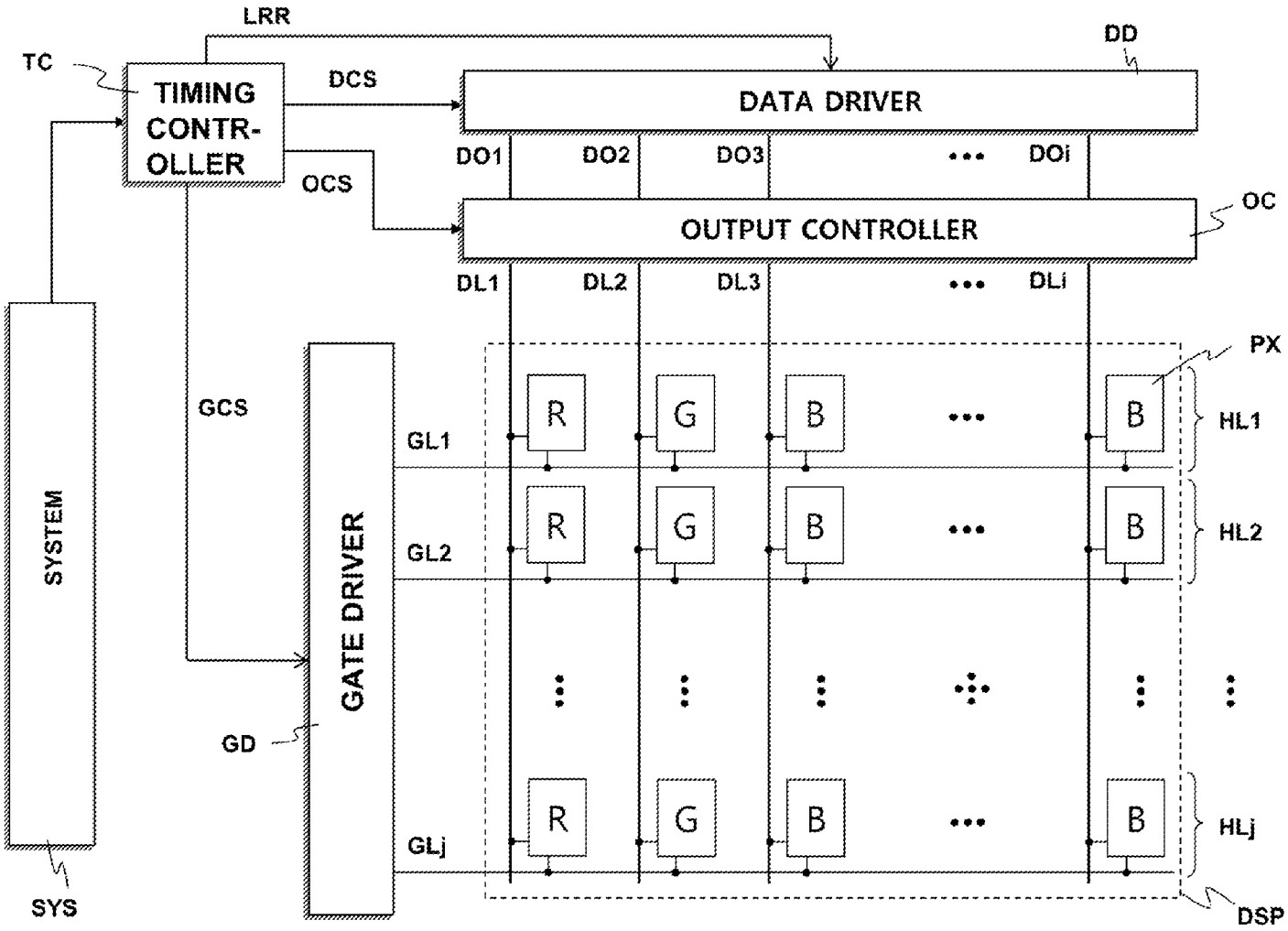
FIG. 1 is a view illustrating a display device according to an embodiment of the present invention.

FIG. 1 is a view illustrating a display device according to an embodiment of the present invention.

The display device according to the present embodiment includes a display unit DSP, a system SYS, a timing controller TC, a data driver DD, an output controller OC, and a gate driver GD, as illustrated in FIG. 1.

The display unit DSP includes i*j pixels PXs, i (i being a natural number greater than 1) data lines, and j gate lines GL1 through GLj. Here, $1_{st}$ through $j_{th}$ gate signals are applied to $1_{st}$ through $j_{th}$ gate lines GL1 through GLj, respectively, and data voltages are input to $1_{st}$ through $i_{th}$ data lines DL1 through DLi, respectively.

The pixels PX are arranged in a matrix form on the display unit DSP. The pixels PX are classified into red pixels R for displaying red colors, green pixels G for displaying green colors, and blue pixels B for displaying blue colors. In this case, a red pixel R, a green pixel G, and a blue pixel B that are adjacent to each other in a horizontal direction constitute a unit pixel for displaying one unit image. Here, when the display device according to the present embodiment is a liquid crystal display (LCD) device, the pixels PX may include a thin film transistor (TFT), a pixel electrode, a common electrode, liquid crystals, and so on.

i pixels (hereinafter, referred to as '$n_{th}$ horizontal line pixels') that are arranged on an $n_{th}$ horizontal line (n being any one of 1 through j) are connected to the first through $i_{th}$ data lines DL1 through DLi through TFTs, respectively. In addition, the $n_{th}$ horizontal line pixels are commonly connected to an $n_{th}$ gate line through the respective TFTs. Thus, the $n_{th}$ horizontal line pixels commonly receive an $n_{th}$ gate signal. That is, i pixels that are arranged on the same horizontal line receive the same gate signal, but pixels that are positioned on different horizontal lines receive different gate signals. For example, red pixels R, green pixels G, and blue pixels B which are positioned on a first horizontal line HL1 receive a first gate signal, but red pixels R, green pixels G, and blue pixels B which are positioned on a second horizontal line HL2 receive a second gate signal having different timing from that of the first gate signal.

The aforementioned j gate signals have the same type pulse, except that output timings are different in terms of time.

The system SYS outputs a vertical synchronization signal, a horizontal synchronization signal, a clock signal, and image data through a transmitter of a graphic controller to an interface circuit. The vertical/horizontal synchronization signal and clock signal output from the system SYS are provided to the timing controller TC through the interface circuit. In addition, the image data that are sequentially output from the system SYS are provided to the timing controller TC through the interface circuit.

The timing controller TC receives the horizontal synchronization signal, the vertical synchronization signal, a data enable signal, a clock signal, and image data from the interface circuit. The vertical synchronization signal indicates time required to display an image of one frame. The horizontal synchronization signal indicates time required to display one horizontal line of an image, that is, one pixel line. Thus, the horizontal synchronization signal includes pulses equal in number to the number of pixels included in one pixel line. The data enable signal indicates a period in which valid image data are positioned. In addition, the timing controller TC rearranges image data such that image data having a predetermined bit, which is provided from the interface, may be provided to the data driver DD. A control signal generator receives the horizontal synchronization signal, the vertical synchronization signal, the data enable signal, and the clock signal from the interface circuit, generates a data control signal, an output control signal, and a gate control signal GCS. The control signal generator provides the data control signal, the output control signal, and the gate control signal GCS to the data driver DD, the output controller OC, and the gate driver GD, respectively. In addition, the timing controller TC outputs a low refresh rate signal LRR and provides the low refresh rate signal LRR to the data driver DD. In this regard, output of the low refresh rate signal LRR is controlled according to analysis results of the image data from the system SYS. For example, when the image data analyzed by the system SYS is confirmed as a video image, the system SYS provides the confirmation information to the timing controller TC. In this case, the timing controller TC does not output the low refresh rate signal LRR in response to the confirmation information. That is, when the video image is displayed, the timing controller TC generates the low refresh rate signal LRR in a low state. On the other hand, when the image data analyzed by the system SYS is confirmed as a still image, the system SYS provides the confirmation information to the timing controller TC. In this case, the timing controller TC outputs the low refresh rate signal LRR for remaining frame periods except for a specific frame period in response to the confirmation information. That is, when the still image is displayed, the timing controller TC outputs the low refresh rate signal LRR in a high state for the aforementioned remaining frame periods only and outputs the low refresh rate signal LRR in a low state for the specific frame period.

A data control signal DCS provided to the data driver DD may include a source sampling clock signal SSC, a source output enable signal SOE, a source start pulse signal SSP, a polarity reverse signal POL, and so on. The source sampling clock signal SSC is used as a sampling clock for latching image data by the data driver DD and to determine a driving frequency of the data driver DD. The source output enable signal SOE is used to transmit the image data latched by the source sampling clock signal SSC to a display unit. The source start pulse signal SSP is a signal indicating beginning of latch or sampling of the image data for one horizontal period. The polarity reverse signal POL is a signal indicating polarity of a data voltage (an analog signal regarding image data) to be applied to a pixel for inversion driving of a display device.

The data driver DD converts image data input thereto into analog data voltages using a preset grayscale voltage in response to the data control signal DCS input from the timing controller TC and applies the data voltages to i data output ports DO1 through DOi. In this case, the data driver DD outputs data voltages to the i data output ports DO1 through DOi in response to a source output enable signal from the timing controller TC. That is, the data driver DD latches i image data at a point of time of a rising edge of the source output enable signal SOE at the same time, and then, converts the i latched image data into analog data voltages at a point of time of a falling edge of the source output enable signal SOE, and then outputs the analog data voltages at the same time.

The data driver DD determines a refresh rate of an image in response to the low refresh rate signal LRR input from the timing controller TC. For example, as described above, when the image analyzed by the system SYS is a video image, the data driver DD processes image data at a preset normal refresh rate. This means that data voltages are output at a normal refresh rate. That is, when the image data analyzed by the system SYS is a video image, the timing controller TC outputs and provides the low refresh rate signal LRR in a low state to the data driver DD. In this case, the data driver DD operates in a normal refresh mode in response to the refresh rate signal in a low state. In the normal refresh mode, image data of one frame are processed every frame period. In this regard, when the data driver DD operates in a normal refresh mode, the data driver DD maintains buffers installed therein in an on state. On the other hand, as described above, when the image analyzed by the system SYS is a still image, the data driver DD processes the image data at a lower refresh rate than the normal refresh rate. This means that the data voltages are output at a low refresh rate. That is, when the image data analyzed by the system SYS is a still image, the timing controller TC outputs and provides the low refresh rate signal LRR that alternately has high and low states, to the data driver DD. In this case, the data driver DD operates in a low speed refresh mode in response to the refresh rate signal. In the low speed refresh mode, image data of one frame is processed for a preset specific frame period only. In this regard, when the data driver DD operates in a low speed refresh mode, the data driver DD maintains buffers installed therein in an on state for the specific frame period only and maintains the buffers in an off state for the remaining frame periods.

According to the present invention, the data driver DD turns off the buffers installed therein in the low speed refresh mode every specific frame period, thereby reducing power consumption.

Figure 2:
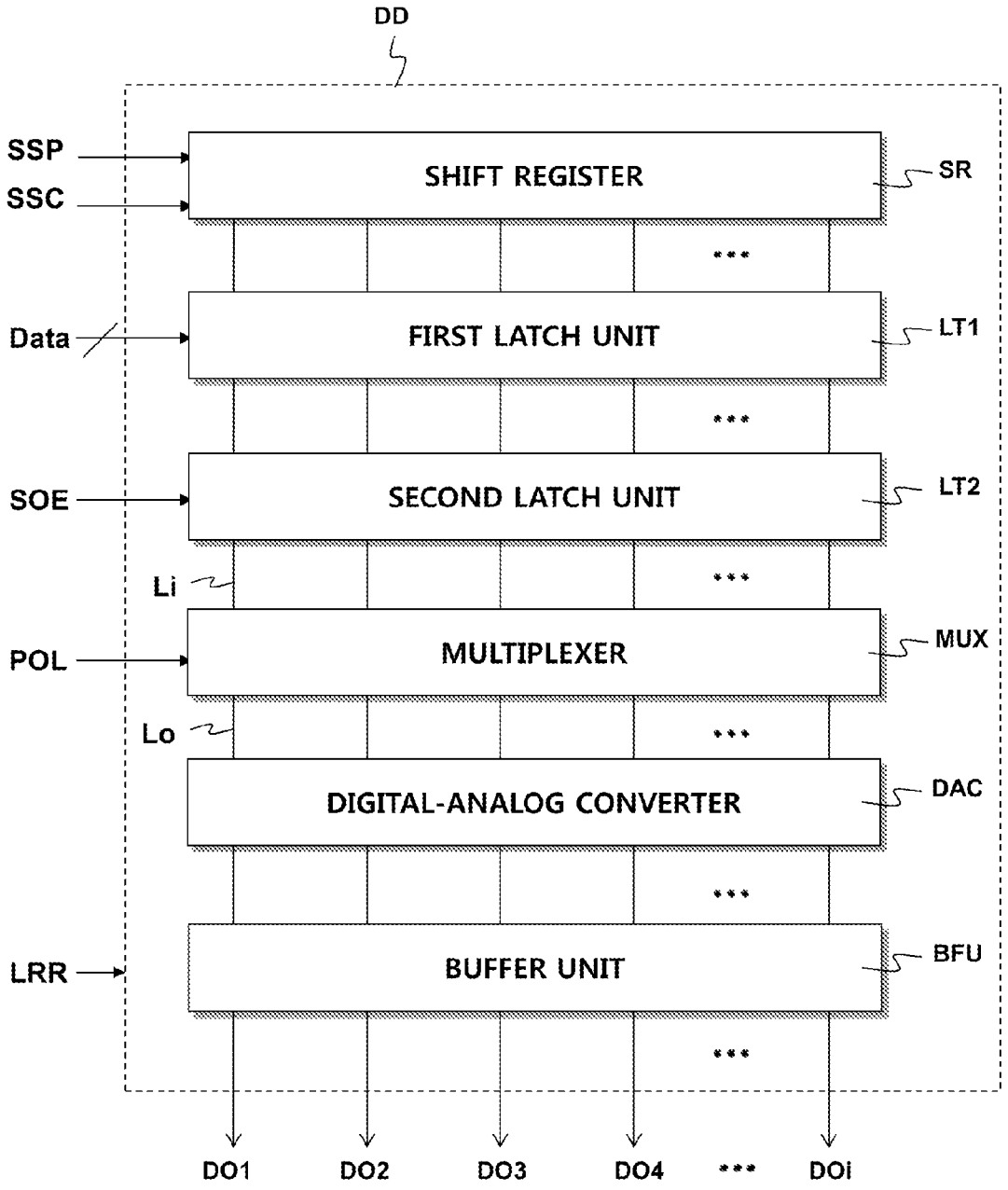
FIG. 2 is a view illustrating a structure of a data driver of FIG. 1.
Figure 3:
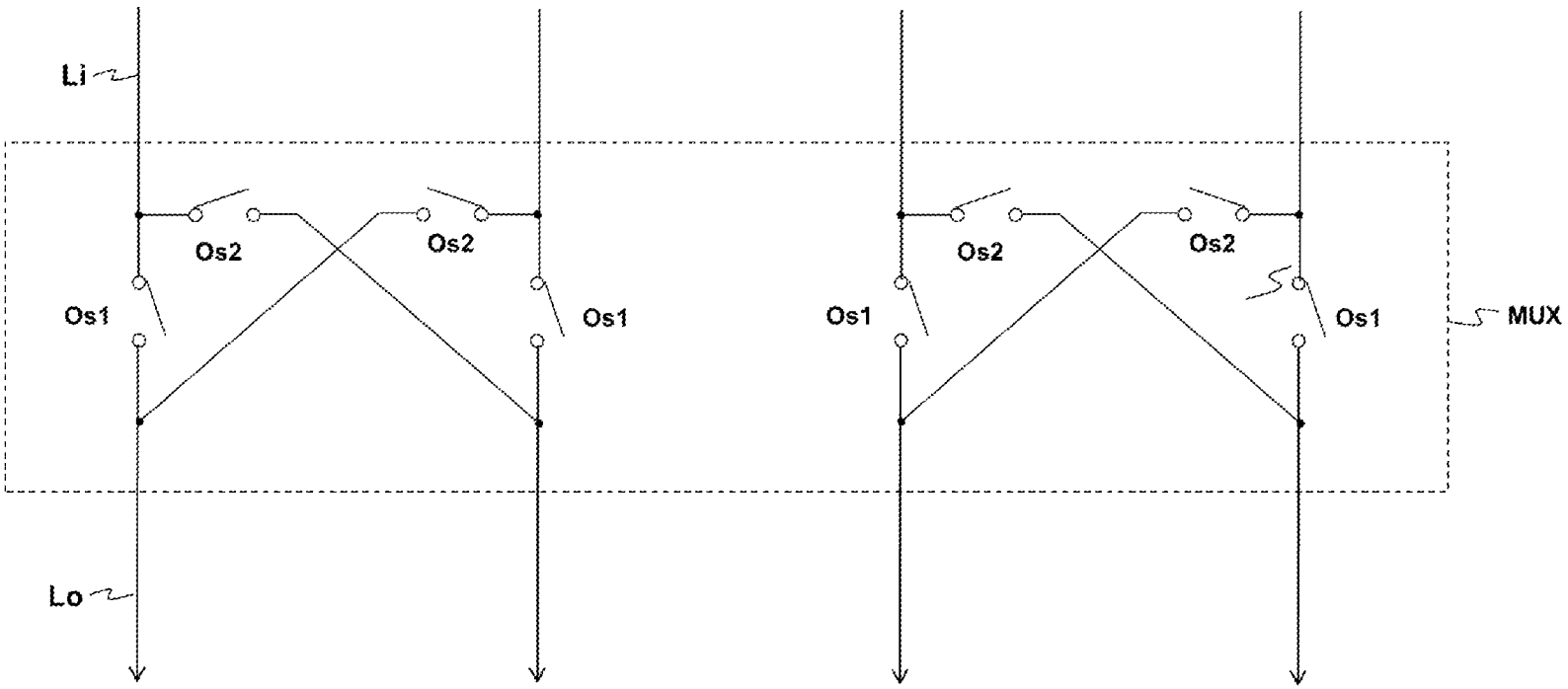
FIG. 3 is a view illustrating a structure of a multiplexer of FIG. 2.
Figure 4:
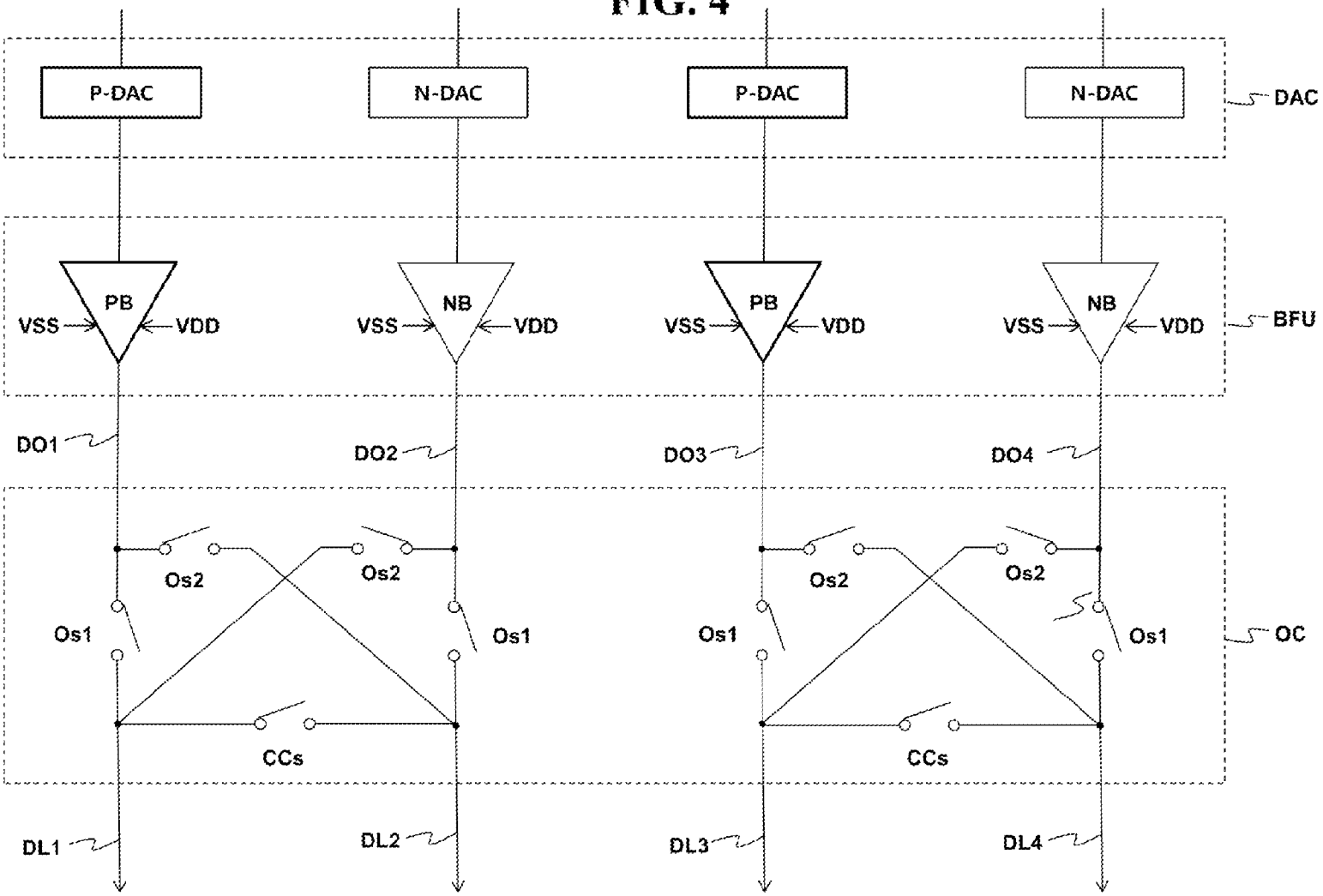
FIG. 4 is a view illustrating structures of a digital-analog converter and buffer unit of FIG. 2 and an output controller of FIG. 1.

With reference to FIGS. 2 through 4, a detailed structure of the data driver DD will be described below.

FIG. 2 is a view illustrating the structure of the data driver DD of FIG. 1, FIG. 3 is a view illustrating a structure of a multiplexer MUX of FIG. 2, and FIG. 4 is a view illustrating structures of a digital-analog converter DAC and buffer unit BFU of FIG. 2 and the output controller OC of FIG. 1.

As illustrated in FIG. 2, the data driver DD includes a shift register SR, a first latch unit LT1, a second latch unit LT2, the multiplexer MUX, the digital-analog converter DAC, and the buffer unit BFU.

The shift register SR sequentially generates sampling signals based on a source start pulse signal SSP and a source sampling clock signal SSC.

The first latch unit LT1 sequentially samples image data of one horizontal line according to the sampling signals from the shift register SR and latches the sampled image data.

The second latch unit LT2 simultaneously latches the image data sampled by the first latch unit LT1 at a point of time of a rising edge of the source output enable signal SOE and simultaneously outputs the latched sampled image data at a point of time of a falling edge of the source output enable signal SOE.

The multiplexer MUX simultaneously receives sampling image data from the second latch unit LT2 and changes an output position of the sampling image data according to the polarity reverse signal POL. To this end, the multiplexer MUX includes a plurality of first output control switches Os1 and a plurality of second output control switches Os2, as illustrated in FIG. 3. FIG. 3 illustrates only some of the first output control switches Os1 and second output control switches Os2.

A first output control switch Os1 is controlled according to a first switch control signal from the timing controller TC and is connected between an input line Li and an output line Lo that correspond to each other. For example, the first switch control signal may enter an active state when the polarity reverse signal POL is high in level, and enter an inactive state when the polarity reverse signal POL is low in level. When the first switch control signal is in an active state, the first output control switch Os1 receiving the first switch control signal is turned on. On the other hand, when the first switch control signal is in an inactive state, the first output control switch Os1 receiving the first switch control signal is turned off.

The second output control switch Os2 is controlled according to a second switch control signal from the timing controller TC and is connected between the input line Li and an output line Lo corresponding to another input line Li adjacent to the corresponding input line Li. For example, the second switch control signal may enter inactive level when the polarity reverse signal POL is high in level and enter an active state when the polarity reverse signal POL is low in level. When the second switch control signal is in an active state, the second output control switch Os2 receiving the second switch control signal is turned on. On the other hand, when the second switch control signal is in an inactive state, the second output control switch Os2 receiving the second switch control signal is turned off.

The digital-analog converter DAC converts the sampling image data provided from the multiplexer MUX into data voltages that are analog signals. As illustrated in FIG. 4, the digital-analog converter DAC includes a plurality of positive digital-analog converters P-DAC and a plurality of negative digital-analog converters N-DAC, which are installed therein. A positive digital-analog converter P-DAC converts image data input thereto into a positive data voltage using positive gamma voltages. A negative digital-analog converter N-DAC converts image data input thereto into a negative data voltage using negative gamma voltages. FIG. 4 illustrates only some of the positive digital-analog converters P-DAC and negative digital-analog converters N-DAC.

The buffer unit BFU buffers and outputs the positive data voltages and negative data voltages provided from the digital-analog converter DAC. The buffer unit BFU includes a plurality of positive buffers PB and a plurality of negative buffers NB. The positive data voltages are provided to and buffered by the positive buffers PB. The negative data voltages are provided to and buffered by the negative buffers NB. The buffered positive data voltages and negative data voltages are provided to the output controller OC through the i data output ports DO1 through DOi. FIG. 4 illustrates only some of the positive buffers PB and negative buffers NB.

An output control signal provided to the output controller OC includes switch control signals for control of various switches formed in the output controller OC.

The output controller OC performs control to appropriately apply data voltages from the data driver DD to data lines corresponding thereto according to the output control signal. That is, the data driver DD changes an output position of image data through the multiplexer MUX positioned in the data driver DD according to the aforementioned polarity reverse signal POL in order to reverse the polarity of the image data such that the output position of the data voltages output from the data driver DD may be changed. The output controller OC re-changes positions of the data voltages such that the data voltages may be applied to an original corresponding data line. In addition, the output controller OC connects a data line to which a positive data voltage is applied and a data line to which a negative data voltage is applied, to each other for a blank period of every frame to raise or lower the voltages of the data lines to a level of a common voltage. Thus, when a data voltage with opposite polarity to a previous frame is applied to a data line, a charging speed of the data line may be increased.

As illustrated in FIG. 4, the output controller OC includes a plurality of first output control switches Os1, a plurality of second output control switches Os2, and a plurality of charge control switches CCs. FIG. 4 illustrates only some of the first output control switches Os1, the second output control switches Os2, and the charge control switches CCs. Here, the first and second output control switches Os1 and Os2 of the output controller OC are materially the same as the first and second output control switches Os1 and Os2 of the aforementioned multiplexer MUX, except for a connection portion thereof.

The first output control switch Os1 of FIG. 4 is controlled according to the first switch control signal from the timing controller TC and is connected between the data output port DO1 and the data line DL1 that correspond to each other. For example, when the first switch control signal may enter an active state when the polarity reverse signal POL is high in level and enter an inactive state when the polarity reverse signal POL is low in level. When the first switch control signal is in an active state, the first output control switches Os1 receiving the first switch control signal is turned on. On the other hand, when the first switch control signal is in an inactive state, the first output control switches Os1 receiving the first switch control signal is turned off.

The second output control switch Os2 of FIG. 4 is controlled according to the second switch control signal from the timing controller TC and is connected between the data output port DO1 and a data line DL2 corresponding to another data output port DO2 adjacent to the corresponding data output port DO1. For example, the second switch control signal may enter an inactive level when the polarity reverse signal POL is high in level and enter an active state when the polarity reverse signal POL is low in level. When the second switch control signal is in an active state, the second output control switch Os2 receiving the second switch control signal is turned on. On the other hand, when the second switch control signal is in an inactive state, the second output control switch Os2 receiving the second switch control signal is turned off.

When sampling image data output from the multiplexer MUX of the data driver DD corresponds to the first data line DL1 and is output through the positive digital-analog converter P-DAC and the positive buffer PB, the first output control switches Os1 are turned on, but the second output control switches Os2 are turned off. Thus, the sampling image data corresponding to the first data line DL1 is applied to the first data line DL1. However, when sampling image data output from the multiplexer MUX of the data driver DD corresponds to the second data line DL2 and an output position of the image data is changed so as to be input to the positive digital-analog converter P-DAC and the positive buffer PB, which correspond to the first data line DL1, the first output control switches Os1 are turned off, but the second output control switches Os2 are turned on. Thus, a positive data voltage corresponding to the sampling image data corresponding to the aforementioned second data line DL2 is appropriately applied to the second data line DL2.

A charge control switch CC is controlled according to a third switch control signal from the timing controller TC and connected between data lines DL1 and DL2 which are adjacent to each other. The charge control switch CC is only turned on for a blank period of every frame and maintained in an off state for the remaining period except for the blank period.

The gate control signal GCS applied to the gate driver GD of FIG. 1 may include a gate start pulse signal GSP, a gate shift clock signal GSC, a gate output enable signal GOE, and so on. The gate start pulse signal GSP is a signal for control of timing of a first gate signal of the gate driver GD, the gate shift clock signal GSC is a signal for sequentially shifting and outputting the gate start pulse signal GSP, and the gate output enable signal GOE is a signal for control of output timing of the gate driver GD.

The gate driver GD controls on/off of TFTs in pixels in response to the gate control signal GCS input from the timing controller TC and allows data voltages applied from the data driver DD to be applied to a pixel electrode connected to each TFT. To this end, the gate driver GD sequentially outputs gate signals and sequentially applies the gate signals to the gate lines GL1 through GLj. Whenever one gate line is driven, data voltages to be applied to pixels R, G, and B of one horizontal line are applied to the i data output ports DO1 through DOi.

Hereinafter, structures of the positive buffer PB and the negative buffer NB will be described in detail with reference to FIG. 5.

Figure 5:
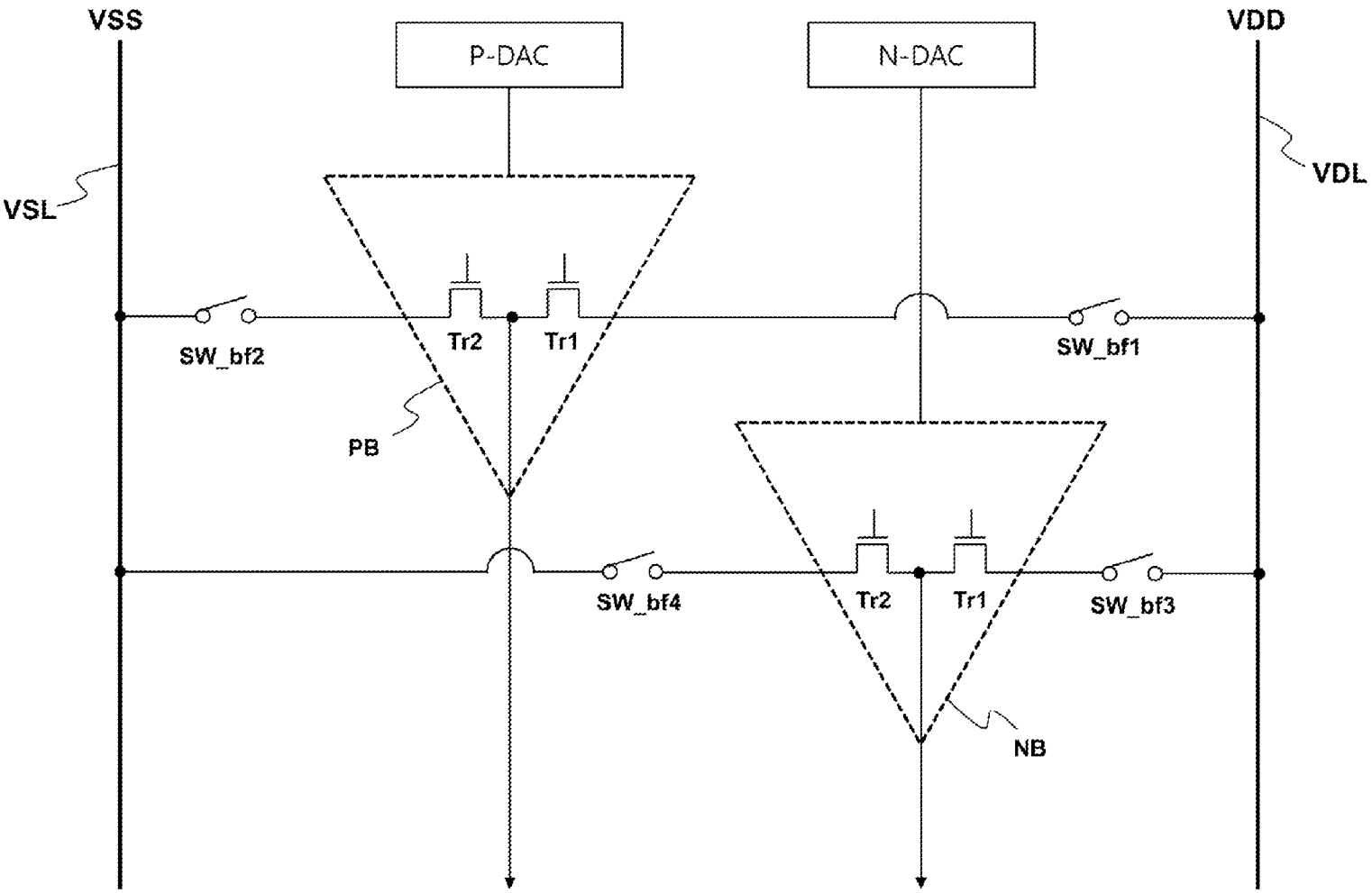
FIG. 5 is a view illustrating structures of a positive buffer and negative buffer of FIG. 4 and a connection relationship between buffer switches connected to the buffers.

FIG. 5 is a view illustrating the structures of the positive buffer PB and negative buffer NB of FIG. 4 and a connection relationship between buffer switches connected to the buffers PB and NB.

The positive buffer PB receives a high voltage VDD and a low voltage VSS to output a positive data voltage. The negative buffer NB receives a high voltage VDD and a low voltage VSS to output a negative data voltage.

Each of the positive buffer PB and the negative buffer NB includes a pull up switching device Tr1 and a pull down switching device Tr2. The pull up switching device Tr1 switches and outputs the high voltage VDD, and the pull down switching device Tr2 switches and outputs the low voltage VSS.

The high voltage VDD is transmitted through a high voltage transmission line VDL and the low voltage VSS is transmitted through a low voltage transmission line VSL.

A first buffer control switch SW_bf1 is connected between the high voltage transmission line VDL and the positive buffer PB. A second buffer control switch SW_bf2 is connected between the low voltage transmission line VSL and the positive buffer PB.

A third buffer control switch SW_bf3 is connected between the high voltage transmission line VDL and the negative buffer NB. A fourth buffer control switch SW_bf4 is connected between the low voltage transmission line VSL and the negative buffer NB.

In a normal refresh mode, the data driver DD turns on the first through fourth buffer control switches SW_bf1 through SW_bf4 every frame period to hold the positive and negative buffers PB and NB in an on state. That is, in the normal refresh mode, the data driver DD maintains the first through fourth buffer control switches SW_bf1 through SW_bf4 in an on state regardless of a frame period.

On the other hand, in a low speed refresh mode, the data driver DD turns on the first through fourth buffer control switches SW_bf1 through SW_bf4 to hold positive and negative buffers in an on state every specific frame period, and turns off the first through fourth buffer control switches SW_bf1 through SW_bf4 every remaining frame period except for the specific frame period to hold the positive and negative buffers PB and NB in an off state.

In order to control the first through fourth buffer control switches SW_bf1 through SW_bf4 in corresponding modes, the low refresh rate signal LRR from the timing controller TC may be supplied directly to the first through fourth buffer control switches SW_bf1 through SW_bf4. In this case, when the low refresh rate signal LRR is in a high state, the first through fourth buffer control switches SW_bf1 through SW_bf4 are turned off. On the other hand, when the low refresh rate signal LRR is in a low state, the first through fourth buffer control switches SW_bf1 through SW_bf4 are turned on.

As another method, a separate switch controller for direct control of the first through fourth buffer control switches SW_bf1 through SW_bf4 may be provided. In this case, the switch controller turns on or off the first through fourth buffer control switches SW_bf1 through SW_bf4 according to the low refresh rate signal LRR from the timing controller TC. In detail, when the low refresh rate signal LRR is in a low state, the switch controller turns on the first through fourth buffer control switches SW_bf1 through SW_bf4. On the other hand, when the low refresh rate signal LRR is in a high state, the switch controller turns off the first through fourth buffer control switches SW_bf1 through SW_bf4. Here, the switch controller may be included in the data driver DD or may be installed in the timing controller TC.

Figure 6:
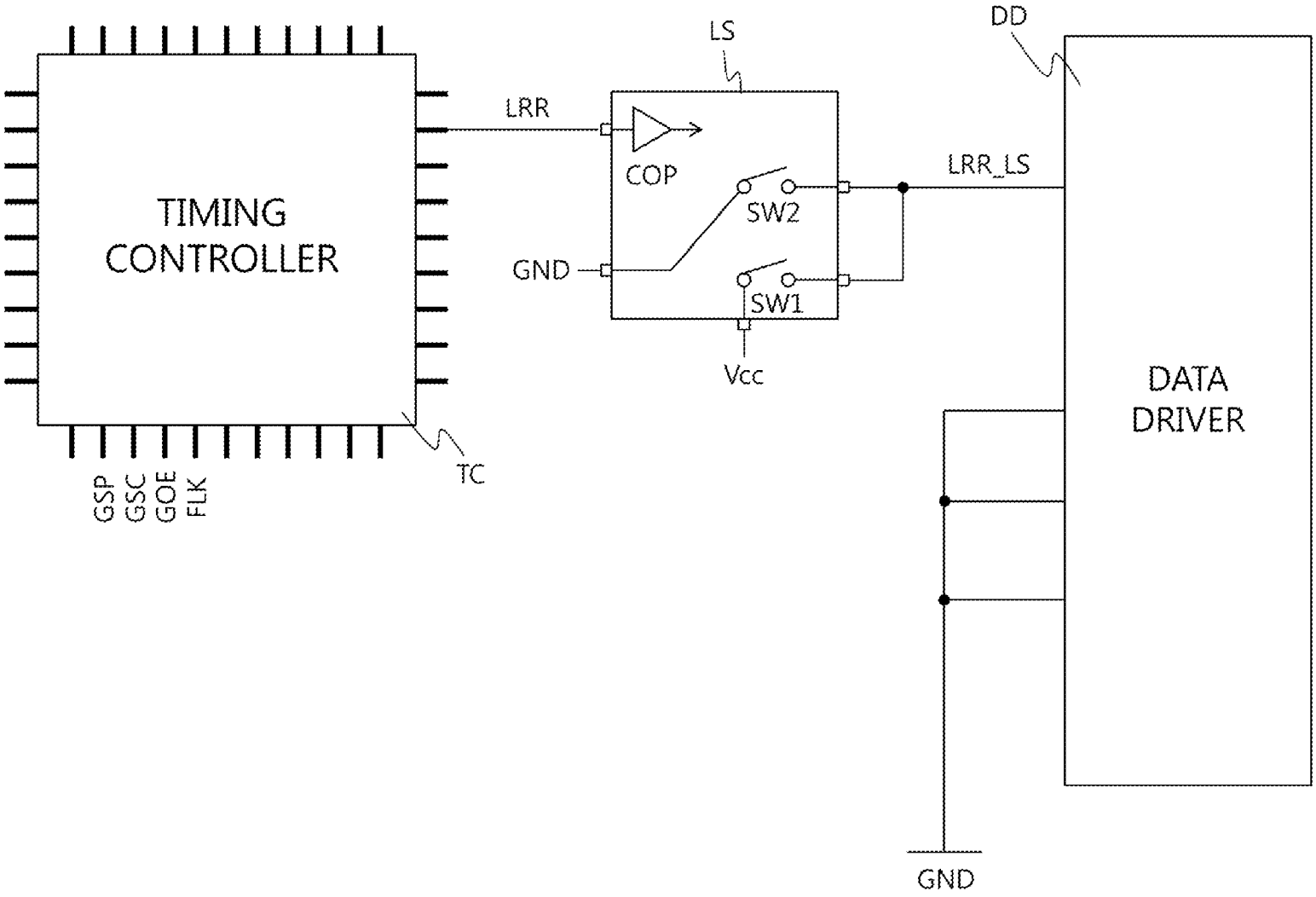
FIG. 6 is a view illustrating a structure for control of operations of first through fourth buffer control switches.

As another method, a structure illustrated in FIG. 6 may control operations of the first through fourth buffer control switches SW_bf1 through SW_bf4.

FIG. 6 is a view illustrating the structure for control of the operations of the first through fourth buffer control switches SW_bf1 through SW_bf4.

As illustrated in FIG. 6, a level shifter LS may be further provided between the timing controller TC and the data driver DD and may shift a level of the low refresh rate signal LRR from the timing controller TC.

The level shifter LS includes a comparer COP, a first switch SW1, and a second switch SW2, as illustrated in FIG. 6.

The comparer COP compares the level of the low refresh rate signal LRR from the timing controller TC with a preset reference value and generates a different size output according to the comparison result. For example, when the level of the low refresh rate signal LRR exceeds the reference value, the comparer COP generates a high-state output. On the other hand, when the level of the low refresh rate signal LRR is equal to or less than the reference value, the comparer COP generates a low-state output. The output from the comparer COP is provided to the first and second switches SW1 and SW2.

The first switch SW1 is turned on or off according to an output from the comparer COP. When the first switch SW1 is turned on, the first switch SW1 switches and outputs a constant voltage Vcc. Here, the constant voltage Vcc may be 3.3 [V].

The second switch SW2 is turned on or off according to an output from the comparer COP. When the second switch SW2 is turned on, the second switch SW2 switches and outputs a ground voltage GND. Here, the ground voltage GND may be 0 [V].

The first switch SW1 and the second switch SW2 operate in opposite ways. That is, when the first switch SW1 is turned on, the second switch SW2 is turned off. In addition, when the first switch SW1 is turned off, the second switch SW2 is turned on.

The level shifter LS having this structure outputs the constant voltage Vcc when the low refresh rate signal LRR input to the level shifter LS is in a high state. On the other hand, the level shifter LS outputs the ground voltage GND when the low refresh rate signal LRR input to the level shifter LS is in a low state. Thus, a waveform of an output LRR_LS from the level shifter LS is the same as a waveform of the low refresh rate signal LRR. However, an amplitude of the output LRR_LS from the level shifter LS is higher than an amplitude of the low refresh rate signal LRR.

The output LRR_LS from the level shifter LS is provided to the data driver DD. In this case, the data driver DD controls operations of the first through fourth buffer control switches SW_bf1 through SW_bf4 according to the output LRR_LS. That is, as described above, the data driver DD may provide the output LRR_LS directly to the first through fourth buffer control switches SW_bf1 through SW_bf4 to control the operations of the first through fourth buffer control switches SW_bf1 through SW_bf4, or control the operations of the first through fourth buffer control switches SW_bf1 through SW_bf4 through a separate switch controller.

Figure 7:
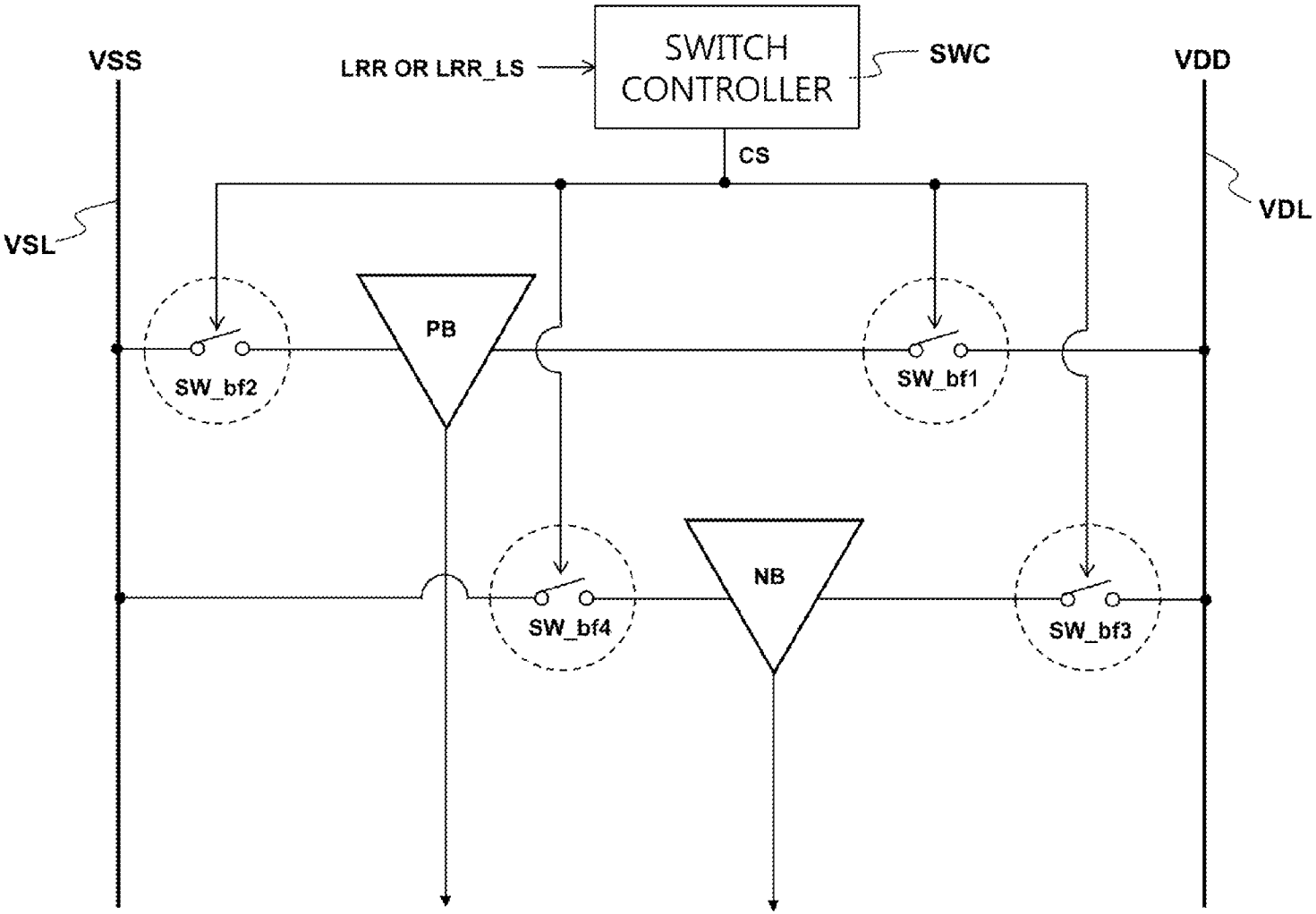
FIG. 7 is a view for explanation of a method of controlling operations of first through fourth buffer control switches through a switch controller.

FIG. 7 is a view for explanation of a method of controlling operations of the first through fourth buffer control switches SW_bf1 through SW_bf4 through a switch controller SWC.

As illustrated in FIG. 7, the switch controller SWC may generate a control signal CS according to the low refresh rate signal LRR from the timing controller TC or the output LRR_LS from the level shifter LS and provide the control signal CS to the first through fourth buffer control switches SW_bf1 through SW_bf4. The control signal CS may have the same waveform as that of the low refresh rate signal LRR.

Figure 8:
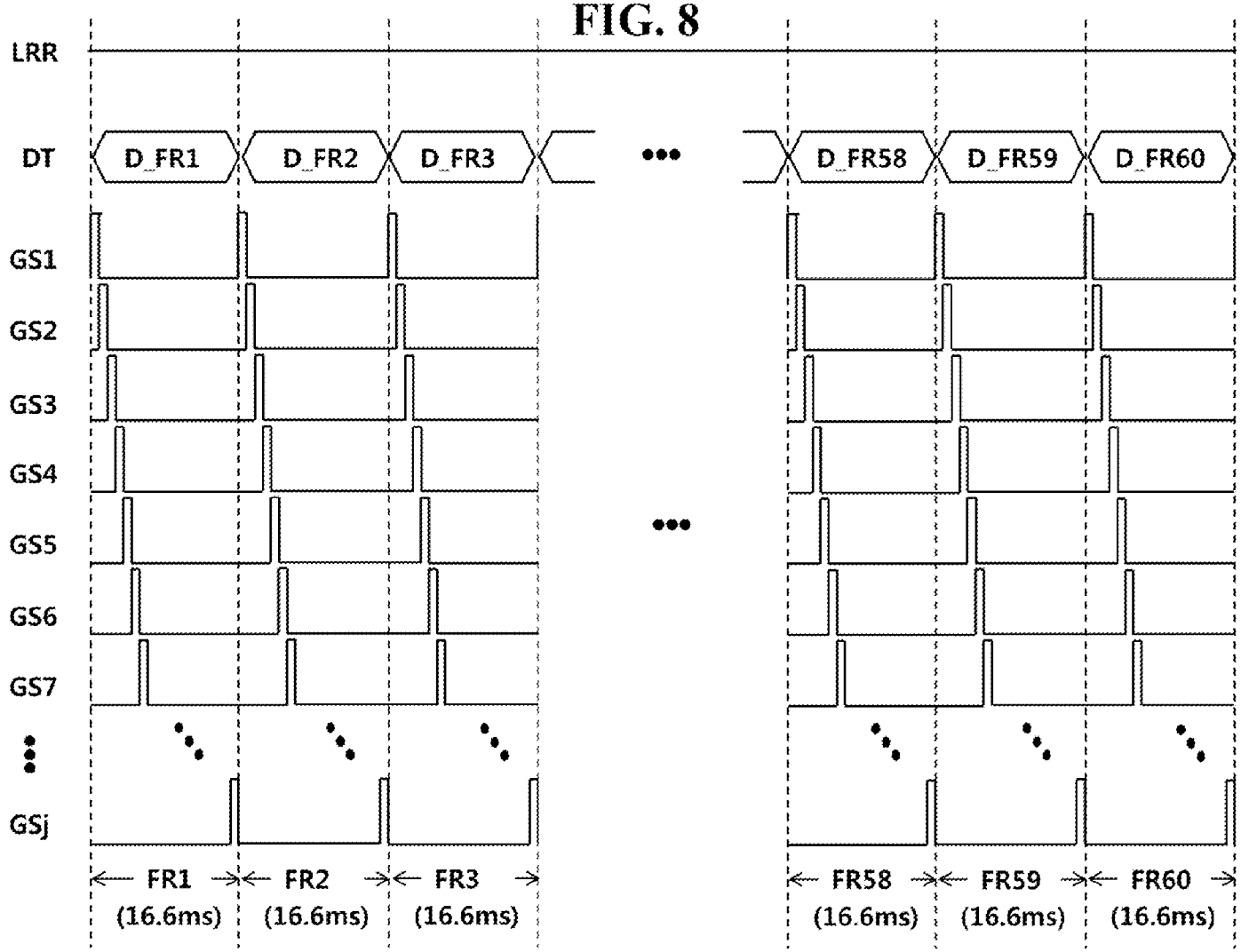
FIG. 8 is a view for explanation of operations of a timing controller, a gate driver, and a data driver in a normal refresh mode.

FIG. 8 is a view for explanation of operations of the timing controller TC, the gate driver GD, and the data driver DD in a normal refresh mode.

In a normal refresh mode, the low refresh rate signal LRR from the timing controller TC is maintained in a high state, image data of one frame is processed by the data driver DD every frame period FR1 through FR60, and j gate signals GS1 through GSj are sequentially output by the gate driver GD every frame period, as illustrated in FIG. 8. Here, assuming that a length of one frame is 16.6 ms, approximately 60 sheets of frames are processed per second, as seen from FIG. 8. That is, the data driver DD performs a refresh operation at 60 Hz. When the data driver DD operates at 60 Hz, for example, the first through 60th frame image data D_FR1 through D_FR60 are processed with the low refresh rate signal LRR maintained in a low state for a total 60 frame period (first through 60th frame periods). In addition, the first through fourth buffer control switches SW_bf1 through SW_bf4 are maintained in an on state for the first through $60^{th}$ frame periods FR1 through FR60.

Figure 9:
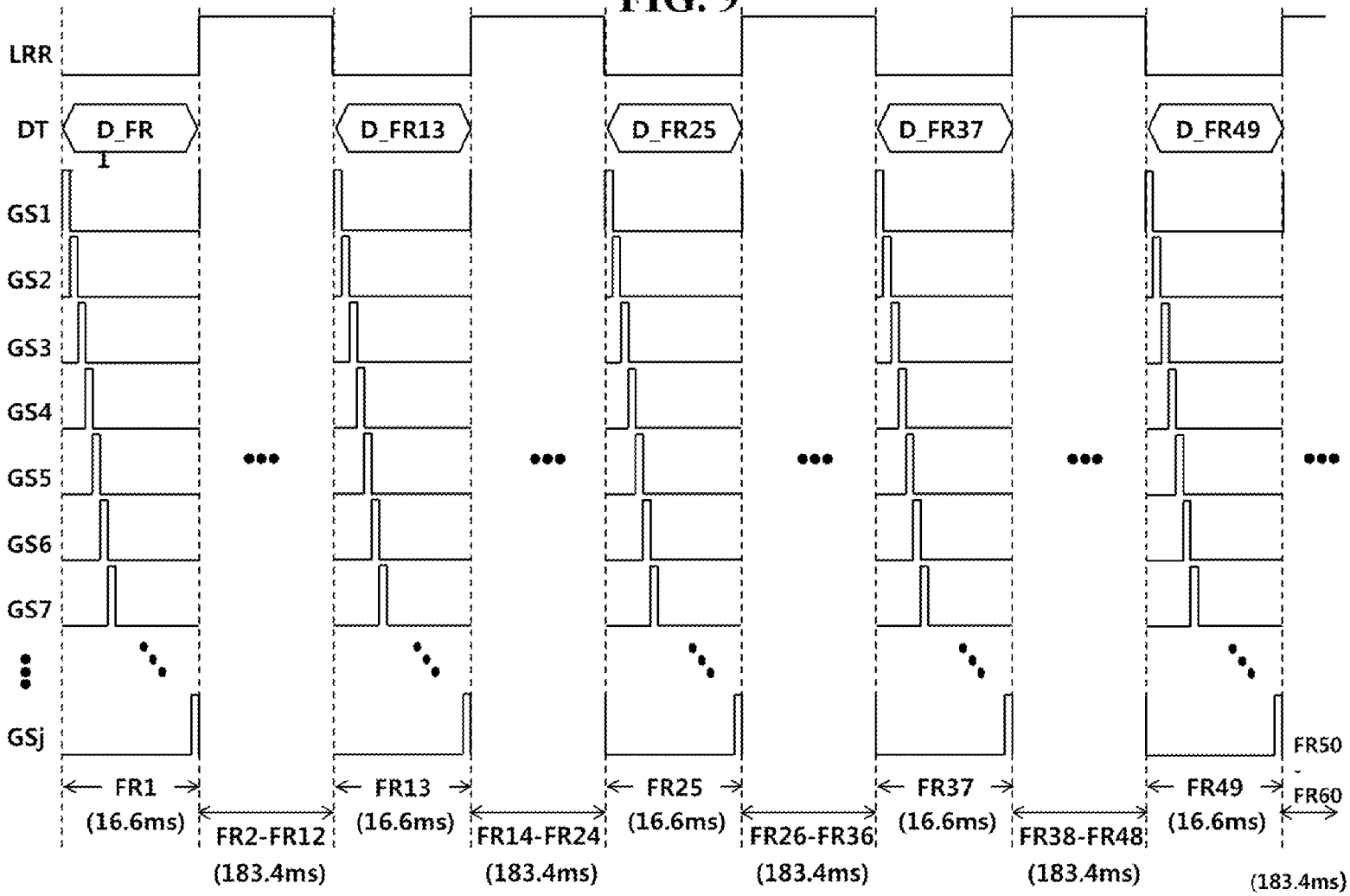
FIG. 9 is a view for explanation of operations of a timing controller, a gate driver, and a data driver in a low speed refresh mode.

FIG. 9 is a view for explanation of operations of the timing controller TC, the gate driver GD, and the data driver DD in a low speed refresh mode.

In the low speed refresh mode, as illustrated in FIG. 9, the low refresh rate signal LRR from the timing controller TC is maintained in a low state for specific frame periods FR1, FR13, FR25, FR37, and FR49, and is maintained in a high state for remaining periods FR2-FR12, FR14-FR24, FR26-FR36, FR38-FR48, and FR50-FR60 except for the specific frame periods. In addition, image data of one frame is processed by the data driver DD every specific frame period and j gate signals GS1 through GSj are sequentially output by the gate driver GD every frame period. Here, assuming that a length of one frame is 16.6 ms, approximately 5 sheets of frames are processed per second, as seen from FIG. 9. That is, the data driver DD performs a refresh operation at 5 Hz. When the data driver DD operates at 5 Hz, for example, the low refresh rate signal LRR is maintained in a low state for only $1^{st}$, $13^{th}$, $25^{th}$, $37^{th}$, and $49^{th}$ frame periods, and frame image data D_FR1, D_FR13, D_FR25, D_FR37, and D_FR49 are processed for only $1^{st}$, $13^{th}$, $25^{th}$, $37^{th}$, and $49^{th}$ frame periods FR1, FR13, FR25, FR37, and FR49 which correspond to specific frame periods among the 60 frame periods. In addition, the first through fourth buffer control switches SW_bf1 through SW_bf4 are turned on for $1^{st}$, $13^{th}$, $25^{th}$, $37^{th}$, and $49^{th}$ frame periods FR1, FR13, FR25, FR37, and FR49.

On the other hand, the low refresh rate signal LRR is maintained in a high state and image data is not processed for $2^{nd}$ through $12^{th}$ frame periods FR2 through FR12, $14^{th}$ through $24^{th}$ frame periods FR14 through FR24, $26^{th}$ through $36^{th}$ frame periods FR26 through FR36, $38^{th}$ through $48^{th}$ frame periods FR38 through FR48, and $50^{th}$ through $60^{th}$ frame periods FR50 through FR60. In addition, the first through fourth buffer control switches SW_bf1 through SW_bf4 are turned off for $2^{nd}$ through $12^{th}$ frame periods FR2 through FR12, $14^{th}$ through $24^{th}$ frame periods FR14 through FR24, $26^{th}$ through $36^{th}$ frame periods FR26 through FR36, $38^{th}$ through $48^{th}$ frame periods FR38 through FR48, and $50^{th}$ through $60^{th}$ frame periods FR50 through FR60.

Referring to FIG. 9, remaining frame periods between two specific adjacent frame periods are set such that time (e.g., 183.4 ms) corresponding to the remaining frame periods between the two specific adjacent frame periods (e.g., FR2-FR12) is greater than time (e.g., 16.6 ms) corresponding to one specific frame period (e.g., FR1) of the two specific adjacent frame periods.

The gate driver GD outputs gate signals GS1 through GSj at the same speed regardless of the normal refresh mode and the low speed refresh mode.

Figure 10:
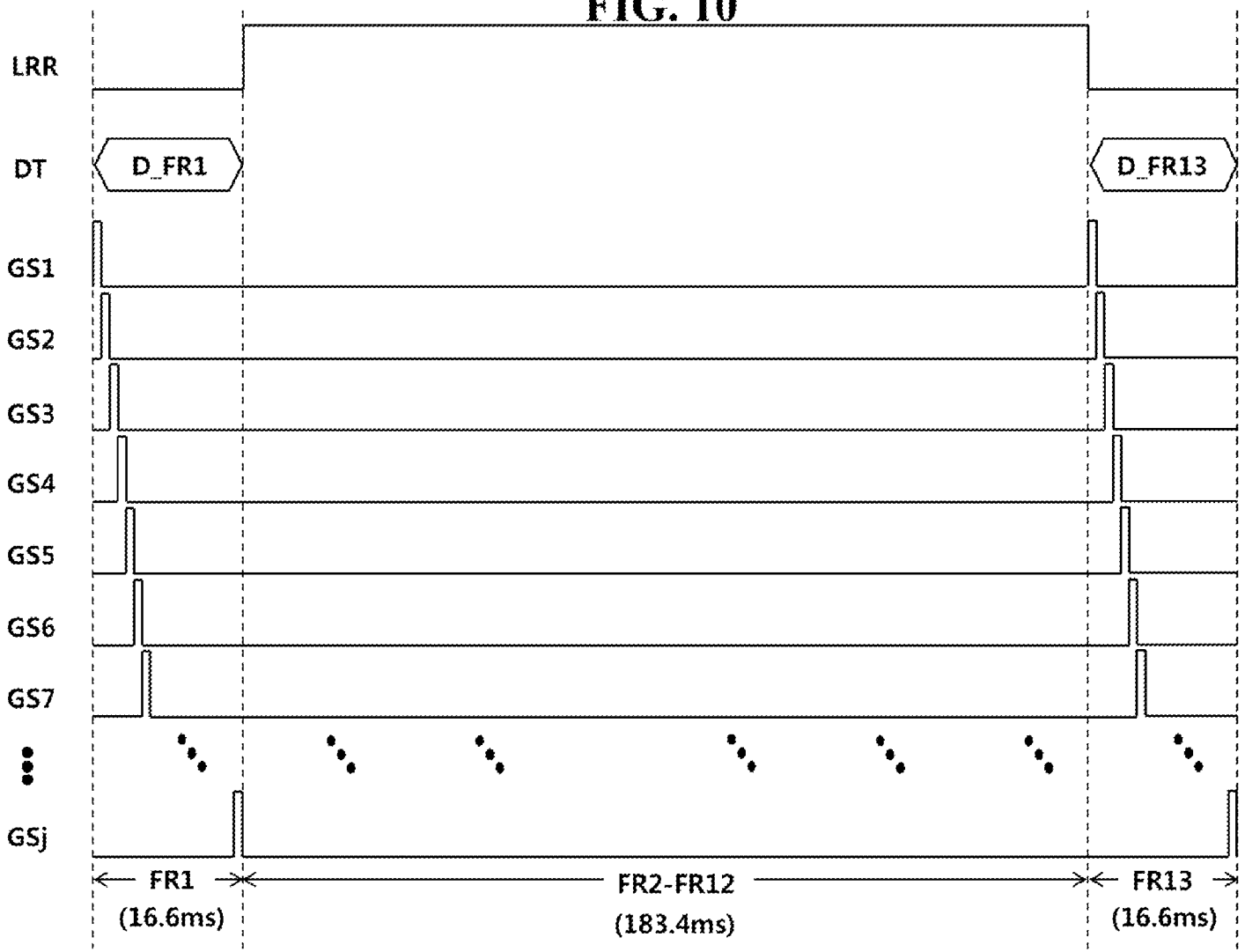
FIG. 10 is a view for explanation of an operation of a gate driver in a low speed refresh mode.

FIG. 10 is a view for explanation of an operation of the gate driver GD in a low speed refresh mode.

As illustrated in FIG. 10, with regard to output speeds of first through jth gate signals GS1 through GSj output for a first frame period FR1 corresponding to a specific frame period, output speeds of the first through jth gate signals GS1 through GSj output for a second frame period FR2 corresponding to the remaining frame period are the same as that of the first frame period FR1. However, waveforms of the first through jth gate signals GS1 through GSj are maintained in a low voltage (gate low voltage; VGL) state in order to hold a TFT of a pixel in an off state.

In addition, a processing speed of image data of one frame processed by the data driver DD for one frame period in a normal refresh mode is the same as a processing speed of image data of one frame processed by the data driver DD for a specific frame period in a low speed refresh mode.

According to the present invention, the positive buffer PB and the negative buffer NB may receive voltages having different amplitudes. For example, the positive buffer PB may receive the high voltage VDD and a common reference voltage. The negative buffer NB may receive a common reference voltage and the low voltage VSS. In this case, the common reference voltage has half an amplitude of the high voltage VDD.

Figure 11:
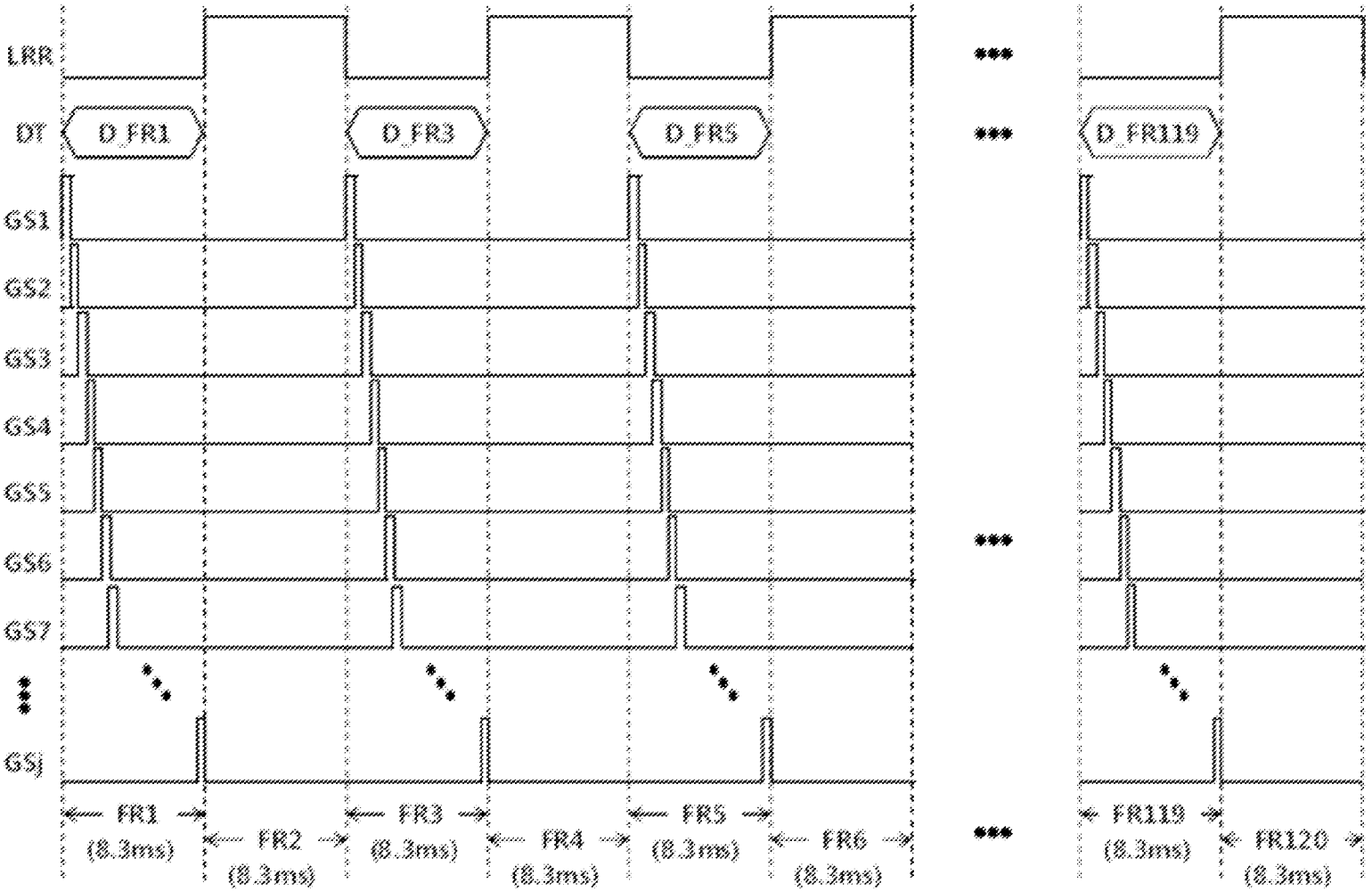
FIG. 11 is another view for explanation of operations of a timing controller, a gate driver, and a data driver in a low speed refresh mode.

FIG. 11 is another view for explanation of operations of the timing controller TC, the gate driver GD, and the data driver DD in a low speed refresh mode.

In the low speed refresh mode, as illustrated in FIG. 11, the low refresh rate signal LRR from the timing controller TC is maintained in a low state for specific frame periods FR1, FR3, FR5, FR7, . . . , FR119 and is maintained in a high state for remaining periods FR2, FR4, FR6, . . . , FR120 except for the specific frame periods. In addition, image data of one frame is processed by the data driver DD every specific frame period and j gate signals GS1 through GSj are sequentially output by the gate driver GD every frame period. Here, assuming that a length of one frame is 8.3 ms, approximately 60 sheets of frames are processed per second, as seen from FIG. 11. That is, the data driver DD performs a refresh operation at 60 Hz. When the data driver DD operates at 60 Hz, for example, the low refresh rate signal LRR is maintained in a low state and first, third, fifth, . . . , one hundred nineteenth frame image data D_FR1, D_FR3, D_FR5, . . . , D_FR119 are processed for only first, third, fifth, . . . , one hundred nineteenth frame periods FR1, FR3, FR5, . . . , FR119 corresponding to specific frame periods among the 60 frame periods. In addition, the first through fourth buffer control switches SW_bf1 through SW_bf4 are turned on for first, third, seventh, . . . , one hundred nineteenth frame periods FR1, FR3, FR5, . . . , FR119.

On the other hand, the low refresh rate signal LRR is maintained in a high state and image data is not processed for second, fourth, sixth, . . . , one hundred twentieth frame periods FR2, FR4, FR6, . . . FR120. In addition, first through buffer control switches SW_bf1 through SW_bf4 are turned off for second, fourth, sixth, . . . , one hundred twentieth frame periods FR2, FR4, FR6, . . . FR120.

Referring to FIG. 9, remaining frame periods between two specific adjacent frame periods are set such that time (e.g., 183.4 ms) corresponding to the remaining frame periods between the two specific adjacent frame periods (e.g., FR2-FR12) is greater than time (e.g., 16.6 ms) corresponding to one specific frame period (e.g., FR1) of the two specific adjacent frame periods.

Referring to FIG. 11, remaining frame periods between two specific adjacent frame periods is set such that time (e.g., 8.3 ms) corresponding to a remaining frame period (e.g., FR2) is the same as time (e.g., 8.3 ms) corresponding to one specific frame period (e.g., FR1) of the two specific adjacent frame periods.

The gate driver GD outputs gate signals GS1 through GSj at the same speed regardless of the normal refresh mode and the low speed refresh mode.

FIG. 12 is a view for explanation of an effect of a driving circuit for a display device according to an embodiment of the present invention.

FIG. 12 illustrates simulation results of a Full-VDD structure configured in such a way that a positive buffer and a negative buffer receive both a high voltage and a low voltage, and a HVDD Case 1 structure configured in such a way that the positive buffer and the negative buffer receive the aforementioned common reference voltage.

In the simulation, VCC is set to 1.8 V, VDD is set to 7.59 V, HVDD is set to 3.84 V, a grayscale voltage of Positive White is set to 7.24 V, a grayscale voltage of Positive Black is set to 3.95 V, a grayscale voltage of Negative Black is set to 3.73 V, and a grayscale voltage of Negative White is set to 0.33 V. In addition, in the two structures, a panel type is set to use an LTD-Z method, an inversion mode thereof is set to use a Column & H1-Dot method, and a mode thereof is set to use a Hi-z method. In addition, one horizontal line time 1H-Time is set to 10.8 μs, an enable period of a source output enable signal is set to 0.19 μs, a panel load is set to 6 k/51 pF, and a surrounding temperature is set to 25° C.

In the Full-VDD structure, when a data driver driven at 60 Hz(LiTEST(low)=60 frame and LiTEST(high)=0 frame) displays White on a screen, power consumptions corresponding to VCC and static power (SIDD) are 75.50 mW and 65.60 mW, respectively, and thus, a total power consumption is calculated as 75.50 mW. In this case, 6 k/51 pF is used, and a surrounding temperature is set to 25° C.

In the Full-VDD, when a data driver driven at 1 Hz (LiTEST(low)=1 frame and LiTEST(high)=59 frame) displays White on a screen, power consumptions corresponding to VCC and static power (SIDD) are 0.17 mW and 1.09 mW, respectively, and thus, total power consumption is calculated as 1.26 mW.

When the data driver is driven in a low speed refresh mode (for example, 1 Hz), power consumption of the data driver is significantly reduced.

According to the present invention, a driving circuit and a method of driving the same have the following effects.

According to the present invention, in a low speed refresh mode in which a still image is processed, all buffers installed in a data driver are turned on for frame periods in which output of image data is limited, thereby significantly reducing power consumption of the data driver.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving circuit for a display device, comprising;

a data driver including a plurality of buffers configured to store image data comprising a plurality of frame periods, the buffers when turned on providing the image data to pixels of the display device and when turned off not providing the image data to the pixels of the display device, wherein the data driver drives the display device based on the image data, the data driver configured to maintain the buffers in an on state during a first subset of the frame periods and maintain the buffers in an off state during a second subset of the frame periods.

2. The driving circuit according to claim 1, wherein the buffers comprise a plurality of positive buffers for receiving a high voltage and a low voltage to output a positive data voltage, and a plurality of negative buffers for receiving the high voltage and the low voltage to output a negative data voltage; and wherein the buffers further comprise:

a plurality of first buffer control switches connected between each of the plurality of positive buffers and a high voltage transmission line for transmitting the high voltage;

a plurality of second buffer control switches connected between each of the plurality of positive buffers and a low voltage transmission line for transmitting the low voltage;

a plurality of third buffer control switches connected between each of the plurality of negative buffers and a high voltage transmission line for transmitting the high voltage; and a plurality of fourth buffer control switches connected between each of the plurality of negative buffers and a low voltage transmission line for transmitting the low voltage.

3. The driving circuit according to claim 2, wherein the data driver turns on the first through fourth buffer control switches during the first subset of the frame periods to hold the positive and negative buffers in an on state and turns off the first through fourth buffer control switches during the second subset of the frame periods to hold the positive and negative buffers in an off state.

4. The driving circuit according to claim 3, further comprising a timing controller for generating a low refresh rate signal having a low state during the first subset of the frame periods and having a high state during the second subset of the frame periods, and providing the low refresh rate signal to the first through fourth buffer control switches.

5. The driving circuit according to claim 3, further comprising:

a timing controller for generating a low refresh rate signal having a low state during the first subset of the frame periods and having a high state during the second subset of the frame periods; and a switch controller for controlling operations of the first through fourth buffer control switches according to the low refresh rate signal from the timing controller.

6. The driving circuit according to claim 5, wherein the switch controller turns on the first through fourth buffer control switches when the low refresh rate signal is in a low state; and wherein the switch controller turns off the first through fourth buffer control switches when the low refresh rate signal is in a high state.

7. The driving circuit according to claim 5, further comprising a level shifter for shifting a level of the low refresh rate signal from the timing controller and providing the low refresh rate signal to the switch controller.

8. The driving circuit according to claim 1, wherein time corresponding to one specific frame period is 16.6 ms or 8.3 ms.

9. The driving circuit according to claim 1, wherein one or more frame periods between two consecutive frame periods of the first subset of frame periods are set such that time corresponding to the one or more frame periods is greater than time corresponding to one frame period of the two consecutive frame periods.

10. The driving circuit according to claim 1, wherein one or more frame periods between two consecutive frame periods of the first subset of frame periods are set such that time corresponding to one of the one or more frame periods is the same as time corresponding to one frame period of the two consecutive frame periods.

11. A method of driving a driving circuit for a display device, the display device comprising a data driver that includes a plurality of buffers configured to store image data comprising a plurality of frame periods, the buffers when turned on providing the image data to pixels of the display device and when turned off not providing the image data to pixels of the display device, the method comprising:

maintaining the buffers in an on state during a first subset of the frame periods; and maintaining the buffers in an off state during a second subset of the frame periods.

12. The method according to claim 11, wherein the buffers comprise a plurality of positive buffers for receiving a high voltage and a low voltage to output a positive data voltage, and a plurality of negative buffers for receiving the high voltage and the low voltage to output a negative data voltage; and wherein the maintaining comprises:

holding the positive and negative buffers in an on state by turning on a plurality of first buffer control switches connected between each of the plurality of positive buffers and a high voltage transmission line for transmitting the high voltage, a plurality of second buffer control switches connected between each of the plurality of positive buffers and a low voltage transmission line for transmitting the low voltage, a plurality of third buffer control switches connected between each of the plurality of negative buffers and a high voltage transmission line for transmitting the high voltage, and a plurality of fourth buffer control switches connected between each of the plurality of negative buffers and a low voltage transmission line for transmitting the low voltage; and holding the positive and negative buffers in an off state by turning off the first through fourth buffer control switches.

13. The method according to claim 12, further comprising generating a low refresh rate signal having a low state during the first subset of the frame periods and having a high state during the second subset of the frame periods, and providing the low refresh rate signal to the first through fourth buffer control switches.

14. The method according to claim 12, further comprising:

generating a low refresh rate signal having a low state during the first subset of the frame periods and having a high state during the second subset of the frame periods; and controlling operations of the first through fourth buffer control switches according to the low refresh rate signal.

15. The method according to claim 14, wherein the controlling of the operations of the first through fourth buffer control switches comprises:

turning on the first through fourth buffer control switches when the low refresh rate signal is in a low state; and turning off the first through fourth buffer control switches when the low refresh rate signal is in a high state.

16. The method according to claim 14, further comprising shifting a level of the generated low refresh rate signal.

17. The method according to claim 11, wherein the buffers are maintained in an on state in a normal refresh mode for processing image data of one frame every frame period.

18. The method according to claim 11, wherein time corresponding to one specific frame period is 16.6 ms or 8.3 ms.

19. The method according to claim 11, wherein one or more frame periods between two consecutive frame periods of the first subset of frame periods are set such that time corresponding to the one or more frame periods is greater than time corresponding to one frame period of the two consecutive frame periods.

20. The method according to claim 11, wherein one or more frame periods between two consecutive frame periods of the first subset of frame periods are set such that time corresponding to one of the one or more frame periods is the same as time corresponding to one frame period of the two consecutive frame periods.

* * * * *